United States Patent [19]

Takeuchi et al.

[11] Patent Number: 4,665,878

[45] Date of Patent: May 19, 1987

[54] FUEL SUPPLY CONTROL SYSTEM FOR ENGINE

[75] Inventors: Nobuo Takeuchi; Makoto Hotate; Tadashi Kaneko; Toshio Nishikawa, all of Hiroshima, Japan

[73] Assignee: Mazda Motor Corporation, Hiroshima, Japan

[21] Appl. No.: 781,998

[22] Filed: Oct. 2, 1985

[30] Foreign Application Priority Data

Oct. 5, 1984 [JP] Japan ..... 59-210263

[51] Int. Cl.[4] ..... F02D 41/10

[52] U.S. Cl. ..... 123/492; 123/489

[58] Field of Search ..... 123/440, 489, 492

[56] References Cited

U.S. PATENT DOCUMENTS 4,389,997 6/1983 Nakano et al. ..... 123/489 X 4,408,588 11/1983 Mausner ..... 123/489

4,499,882 2/1985 Saito et al. ..... 123/489 X

*Primary Examiner*—Tony M. Argenbright

*Attorney, Agent, or Firm*—Burns, Doane, Swecker & Mathis

[57] ABSTRACT

A fuel supply control system for an automobile engine which comprises fuel increasing device operable in response to an output fed from an acceleration detector for increasing the quantity of fuel to be supplied, and a rate-of-increase adjusting device for adjusting the rate of increase of the fuel to be supplied. The rate of increase of the fuel to be supplied becomes high as the air-fuel ratio of the combustible air-fuel mixture detected shortly before the acceleration is high.

9 Claims, 10 Drawing Figures

FUEL SUPPLY CONTROL SYSTEM FOR ENGINE

BACKGROUND OF THE INVENTION

The present invention relates to a fuel supply control system for an internal combustion engine.

There is well known a fuel supply control system employing a feedback control scheme wherein the air-fuel ratio of the combustible air-fuel mixture supplied to the engine is monitored by an air-fuel ratio detecting sensor such as, for example, an $O_2$ sensor so that the air-fuel ratio can be controlled to a predetermined value, that is, a stoichiometric value. According to the disclosure of the Japanese Laid-open Patent Publication No. 58-72631, published Apr. 30, 1983, the feedback control of fuel supply is so designed that, upon and after the establishment of a condition requiring the feedback control, the air-fuel ratio of the combustible mixture supplied at low load, low speed operating condition can be controlled in dependence on the load on the engine so as to provide a leaned combustible mixture, but the combustion gases to be supplied during an engine operating condition other than the low, load, low speed engine operating condition can be controlled to the stoichiometric air-fuel ratio.

During the acceleration of the engine, in order to ensure a high power output required during such time, the feedback control described above is interrupted to permit the increased fuel supply to render the air-fuel ratio to be of a low value, for example, 13.

However, the rate of increase of fuel in this case has hitherto been fixed at a particular value, and considering the acceleration from the engine operating condition wherein the feedback control is being effected to provide the air-fuel mixture of stoichiometric ratio, the increased fuel supply according to the fixed rate of increase of fuel is effective to achieve a required characteristic of acceleration because the difference is small between the air-fuel ratio (stoichiometric air-fuel ratio of 14.7) shortly before the start of acceleration and the desired air-fuel ratio (for example, 13) during the acceleration. This two-stage air-fuel control system however has a problem. More particularly, where acceleration is desired to be started from the low load, low speed operating condition of the engine, a considerable increase of the charge incident to the start of acceleration may result in the supply of fuel in a quantity short of the required quantity because the air-fuel ratio shortly before the start of acceleration is high, the consequence of which is the temporal supply of excessively leaned air-fuel mixture. Once this happens, hesitation of acceleration occur in the engine and, in the worst case it may happen, the misfiring ofthe air-fuel mixture may occur.

SUMMARY OF THE INVENTION

Accordingly, the present invention has been developed with a view to substantially eliminating the above discussed problems inherent in the prior art systems and has for its essential object to provide an improved fuel supply control system for an internal combustion engine wherein a desirable acceleration characteristic can be obtained whenever the engine is accelerated from any one of at least two engine operating conditions wherein the air-fuel ratios are controlled to different values, respectively.

To this end, as shown in FIG. 1 of the accompanying drawings which illustrate a concept of the present invention, the present invention is featured in that a fuel increasing means B operable in response to an output fed from an acceleration detecting means A for increasing the quantity of fuel to be supplied is provided with a rate-of-increase adjusting means C for adjusting the rate of increase of the fuel to be supplied so that the higher the air-fuel ratio shortly before the acceleration, the higher the rate of increase of the fuel to be supplied.

According to the present invention, when the acceleration is desired to be started from the engine operating condition in which the air-fuel ratio is controlled to a high value, the fuel can be supplied in an increased quantity, the rate of increase of the fuel being dependent on the air-fuel ratio shortly before the acceleration. Accordingly, there is no possibility of the air-fuel mixture being excessively leaned at the time of start of acceleration and, therefore, any possible occurrence of torque chock resulting from the hesitation of acceleration can advantageously be minimized.

BRIEF DESCRIPTION OF THE DRAWINGS

This and other objects and features of the present invention will become readily understood from the following description taken in conjunction with a preferred embodiment thereof with reference to the accompanying drawings, in which.

DETAILED DESCRIPTION OF THE EMBODIMENT

Figure 1:
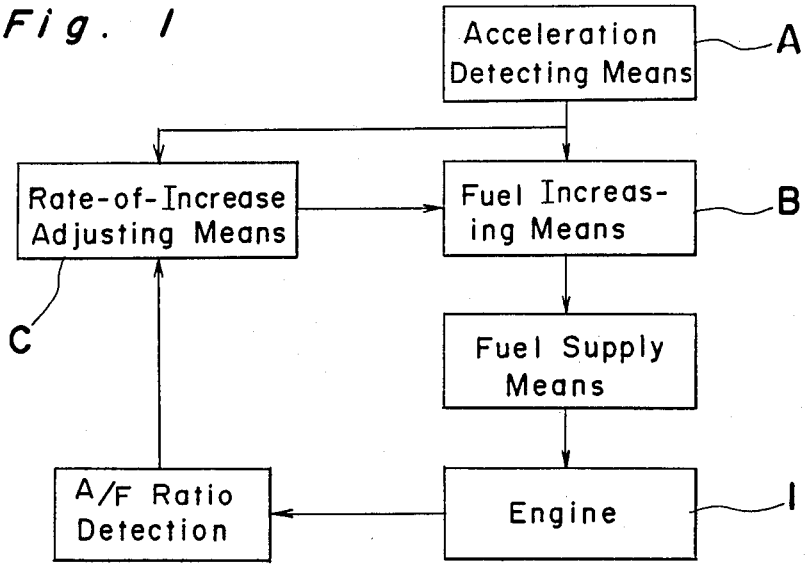
FIG. 1 is a block diagram showing the concept of the present invention.
Figure 2:
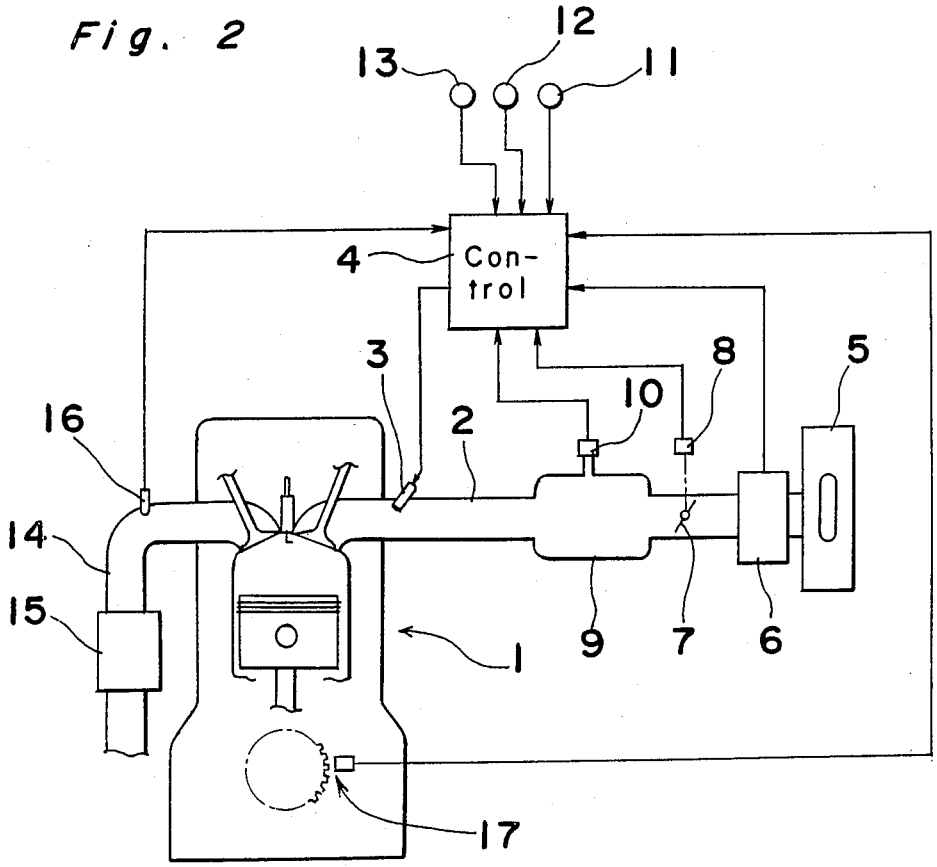
FIG. 2 is a schematic skeleton diagram showing a fuel supply control system according to the present invention.

Referring first to FIG. 2, an automobile engine 1 has an intake passage 2 with a fuel injection valve 3 disposed therein for injecting a controlled quantity of fuel into the intake passage 2. The fuel injection valve 3 is adapted to be controlled by a control unit 4 utilizing a microcomputer.

As principal input data, fed to the control unit 4, the control unit 4 receives an air flow signal indicative of the flow of air detected by and fed from an air flowmeter 6 disposed in the intake passage 2 downstream of an air cleaner 5; a throttle signal indicative of the opening of a throttle valve 7 detected by and fed from a throttle sensor 8, which valve 7 is disposed in the intake passage 2 downstream of the air flowmeter 6; a pressure signal indicative of the negative pressure inside the intake passage 2 detected by and fed from a pressure sensor 10 disposed in a surging tank 9 downstream of the throttle valve 7; an a speed signal indicative of the engine speed detected by and fed from an engine speed sensor 11. As correction input data fed to the control unit 4, the control unit 4 also receives a water temperature signal indicative of the temperature of an engine cooling water detected by and fed from a water temperature sensor 13, and an air temperature signal indicative of the temperature of the suction air detected by and fed from an air temperature sensor 13. Furthermore, the control unit 14 receives, as a feedback data, a A/F signal indicative of the actual air-fuel ratio detected by and fed from an $O_2$ sensor disposed in an exhaust passage 14 of the engine 1 upstream of an exhaust gas purifying unit, for example, an catalytic converter 15 also disposed in the exhaust passage 14.

Also applied to the control unit 4 is an output from a cranking angle sensor 17 of pick-up type operatively coupled with a crankshaft (not shown) of the engine 1. This output from the cranking angle sensor 17 is used as a timing signal, and the control unit 4 calculates, each time this timing signal is applied thereto, the quantity of fuel to be injected into the engine.

Figure 3:
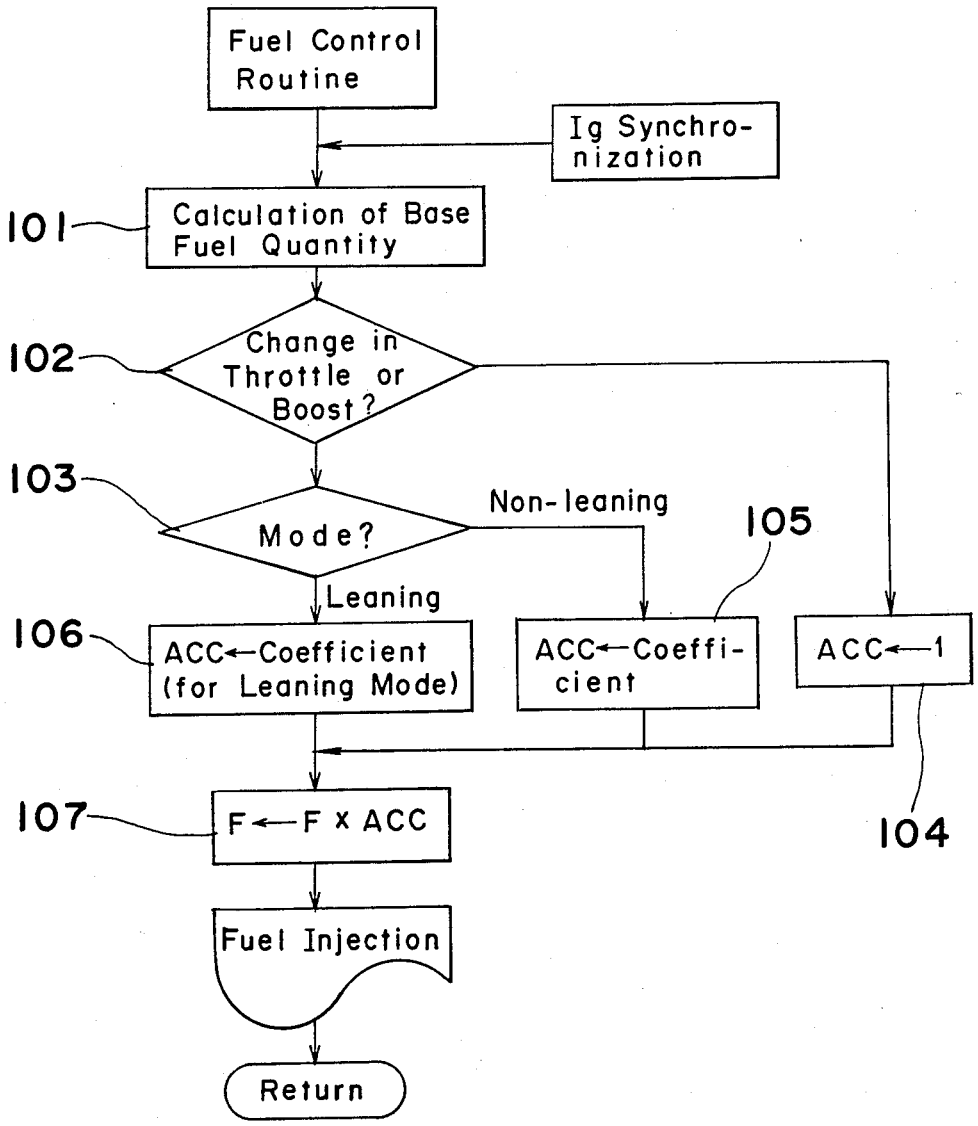
FIG. 3 is a flow-chart showing the programmed sequence of operation of the control system.

A program for the fuel control executed by the control unit 4 is shown in FIG. 3, reference to which will now be made.

As shown in FIG. 3, when the cranking angle of a predetermined value is detected by the cranking angle sensor 17, the base quantity of fuel F is calculated at step 101. This base fuel quantity F is determined in dependence on the engine speed and the flow of suction air and, if necessary, modified in dependence on such correction data as the temperature of the engine cooling water. At subsequent step 102, a change in throttle opening or suction negative pressure is determined and a decision is made to determine if acceleration is taking place. In this decision, the difference $(\theta_{TC}(o)-\theta_{TV}(-\tau)$ between the current throttle opening $Q_{TV}(0)$ obtained by, for example, sampling an the previous throttle opening $Q_{TV}(-\tau)$ assumed a predetermined time $\tau$ before is compared with a predetermined positive constant K and, if this difference is greater than the constant K, the program flow proceeds to step 103 to effect an increased fuel supply for acceleration, but if it is smaller than K signifying a normal operating condition, the program flow proceeds to step 104 at which an acceleration coefficient ACC is set to "1" without the increased fuel supply for acceleration being effected.

At step 103, in readiness for the start of the increased fuel supply for acceleration, a decision is made to determine whether the fuel control mode then assumed is a leaning mode or whether it is a non-leaning mode. At this decision, if the engine speed and the suction negative pressure indicate a low load, low speed operating condition of the engine, the leaning mode (with the air-fuel ratio being, for example, 13) is assumed but if they indicate an engine operating condition other than the low load, low speed operating condition and indicate a feedback control region, the non-leaning mode (with the air-fuel ratio being set to a stoichiometric value).

During the non-leaning mode, and at step 105, the acceleration coefficient ACC is selected to be a standard value, that is, a value required for the air-fuel ratio to be increased from the stoichiometric value (14, 7) to the ratio, for example, 13, required for acceleration.

On the other hand, if the result of decision at step 103 indicates the non-leaning mode, the subsequent step 106 takes place at which the acceleration coefficient ACC is selected for the non-leaning mode. In this case, the acceleration coefficient ACC may be calculated in dependence on, for example, the difference between the current air-fuel ratio and the required air-fuel ratio, or may be determined by adding a predetermined value $\Delta$ACC to the acceleration coefficient ACC for the acceleration from the non-leaning mode.

The acceleration coefficient ACC determined at one of the steps 104, 105 and 106 according to the particular engine operating condition is multiplied at step 107 by the base fuel quantity F, determined at step 101, to give the quantity of fuel required to be then injected. The fuel in a quantity F determined at step 107 is injected at step 108 into the intake passage 2 through the fuel injection valve 3.

When during the acceleration from the engine operating condition requiring the leaned air-fuel mixture, the increase of the fuel supplied for acceleration progresses and the engine operating condition subsequently reaches the one requiring the stoichiometric air-fuel ratio, the decision at step 103 gives such a result that the current fuel control mode in the non-leaning mode (with the air-fuel ratio equal to or higher than 14.7), followed by step 105 at which the acceleration coefficient ACC is selectd to be a standard value.

Although in the foregoing embodiment the acceleration coefficient has been described as calculated each time, it is possible to provide two maps for the increased fuel supply for acceleration and for acceleration from the engine operating condition requiring the combustible mixture of stoichiometric air-fuel ratio, so that the acceleration coefficient can be read from one of these maps depending on the operating condition.

Figure 4:
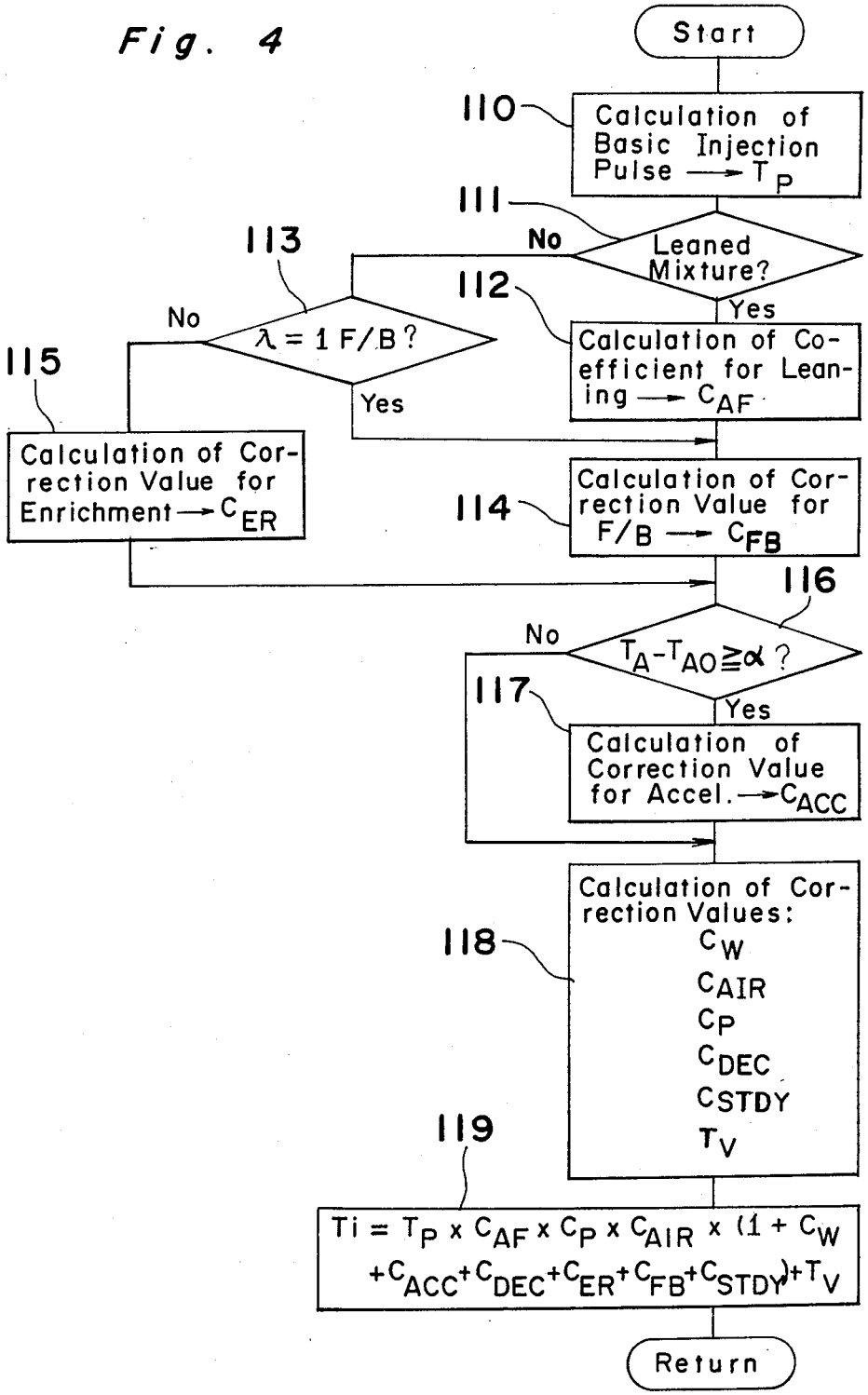
FIG. 4 is a flowchart showing a routine for calculating an injection pulse.

Shown in FIG. 4 is a program routine used to calculate an injection pulse. At step 110, a basic injection pulse Tp is calculated, followed by a decision step 111 to determine if the engine is to be operated with the supply of a leaned combustible air-fuel mixture. If the result of the decision at step 111 indicates that the leaned mixture is to be supplied, a coefficient $C_{AF}$ of leaning of the combustible mixture is calculated at step 112, but if it is not the case, a decision is made at step 113 to determined if a condition of $\lambda=1$ F/B is established. Subsequent to step 112 or if the condition of $\lambda=1$ F/B is established, a correction value $C_{FB}$ for F/B is calculated at step 114, followed by another decision step 116. On the other hand, if the condition of $\lambda=1$ F/B is not established, a correction value $C_{ER}$ for the enrichment of the combustible mixture is calculated at step 115, followed by step 116.

At step 116, for the determination of the acceleration, a decision is made to determined if $T_A-T_{AO}\geqq\alpha$, and if $T_A-T_{AO}\geqq\alpha$, the program flow proceeds to step 117, but if $T_A-T_{AO}\leqq\alpha$, the program flow proceeds to step 118. At step 117, a correction value $C_{ACC}$ for the acceleration is performed.

At step 118, various correction values such as a water temperature correction value $C_W$, a suction air temperature correction value $C_{AIR}$, an atmospheric pressure correction value $C_P$, a deceleration correction value $C_{DEC}$, a learning value $C_{STDY}$ and an invalid injection time $T_V$ are calculated, and at the subsequent step 119, for the determination of the final injection pulse, the following calculation is performed:

$$T_i=T_p\times C_{AF}\times C_P\times C_{AIR}\times(1+C_W+C_{ACC}+C_{DEC}+C_{ER}+C_{FB}+C_{STDY})+T_V$$

In this way, one cycle completes.

Figure 5:
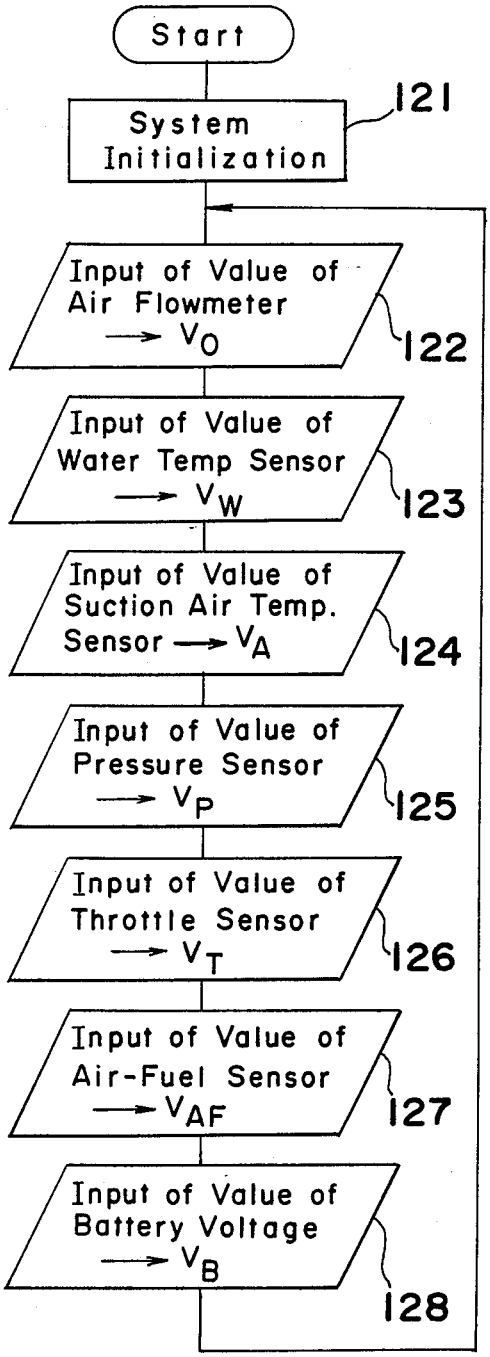
FIG. 5 is a flowchart showing a background routine.

A background routine, that is, an input routine, is shown in FIG. 5. As shown, after the system initialization at step 121, various values, $V_Q$, $V_N$, $V_A$, $V_P$, $V_T$, $V_{AF}$ and $V_B$ are sequentially inputted at respective steps 122 to 128, wherein:

$V_Q$: Value of the air flowmeter, $V_N$: Value of the water temperature sensor, $V_A$: Value of the suction air temperature sensor, $V_P$: Value of the pressure sensor, $V_T$: Value of the throttle sensor, $V_{AF}$: Value of the air-fuel ratio sensor, and $V_B$: Value of a battery voltage.

The calculation of the corrected fuel quantity for the synchronous acceleration is performed in a manner as shown by the flowchart fo FIG. 6, reference to which will now be made.

As shown, at step 130, a decision is made to determine if $T_A - T_{AO} \geqq \alpha$, and if $T_A - T_{AO} \geqq \alpha$, a correction value CACCT is calculated at step 131 according to the acceleration degree ($\alpha T_A$), followed by the calculation at step 132 of a correction value $C_{ACCA}$ according to air-fuel ratio detected shortly before the detection of the acceleration. Thereafter, and at step 133, the calculation of $C_{ACC} = C_{ACCT} \times C_{ACCA}$ is performed to determine the correction value for the acceleration, thereby completing the cycle.

If the result of decision at step 130, however, indicates that $T_A - T_{AO} < \alpha$, the correction value $C_{ACC}$ is assumed to be zero at step 134, thereby completing the cycle.

Figure 6:
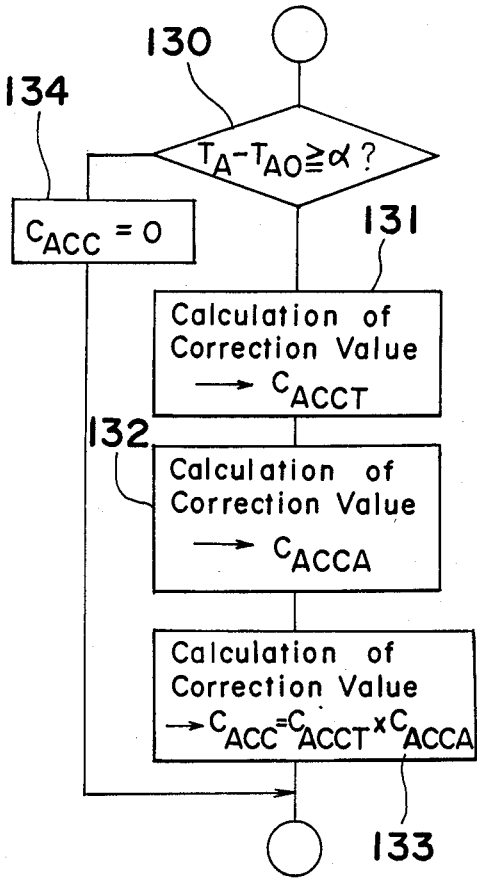
FIG. 6 is a flowchart showing a program flow used to calculate the corrected fuel quantity for the synchronous acceleration.
Figure 7:
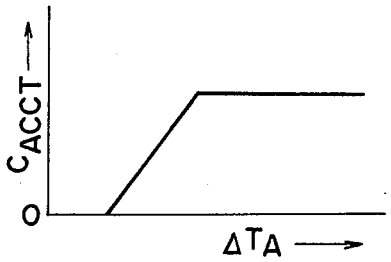
FIG. 7 is a graph showing the relationship between a correction value and the acceleration degree.
Figure 8:
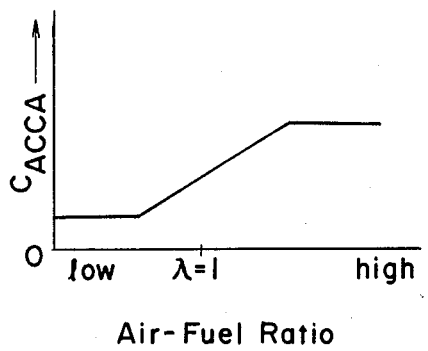
FIG. 8 is a graph showing the relationship between the air-fuel ratio and a correction value.

The relationship between the values $\Delta T_A$ and $C_{ACCT}$ and that between the air-fuel ratio and the value $C_{ACCA}$, both determined according to the flowchart of FIG. 6, are shown in FIGS. 7 and 8, respectively.

Figure 10:
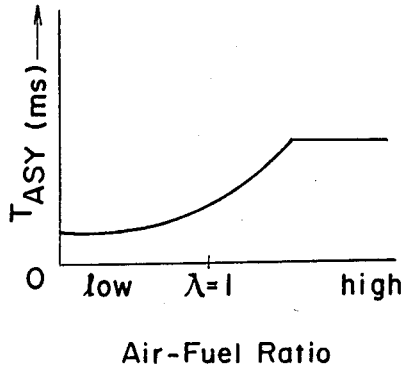
FIG. 10 is a graph showing the relationship between the air-fuel ratio and the injection pulse.
Figure 9:
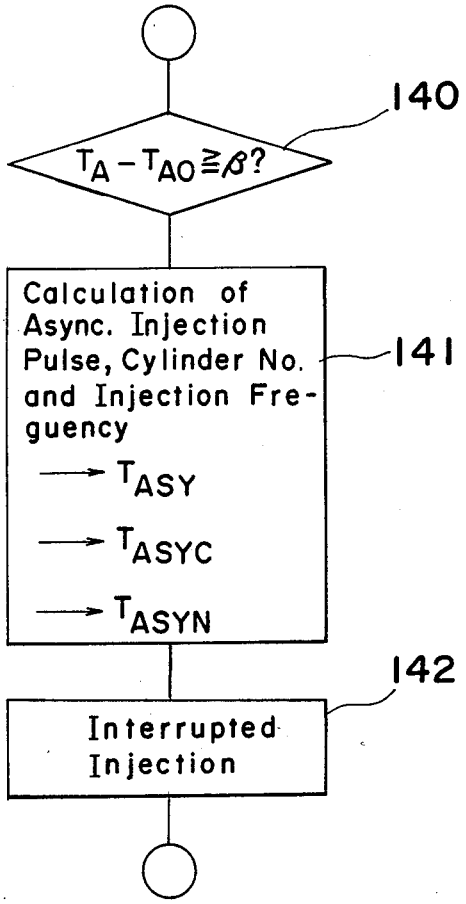
FIG. 9 is a flowchart showing a program flow used to calculate the corrected fuel quantity for the asynchronous acceleration.

In the case of the calculation of the corrected fuel quantity for the asynchronous acceleration, the flowchart shown in FIG. 9 is employed. Referring to FIG. 9, at step 140, a decision is made to determine if $T_A - T_{AO} \geqq \beta$, and then, at step 141, all of the asynchronous injection pulse $T_{ASY}$, the number $T_{ASYC}$ of cylinders injected with the combustible mixture and the frequency $T_{ASYN}$ of fuel injection are calculated in reference to the air-fuel ratio detected shortly before the detection of the acceleration, followed by an interrupted injection at step 142. The relationship between the air-fuel ratio and the asynchronous injection pulse $T_{ASY}$ is shown in FIG. 10.

Although the present invention has been described in connection with the preferred embodiment with reference to the accompanying drawings, it is to be noted that various changes and modifications are apparent to those skilled in the art. Accordingly, such changes and modifications are to be construed as included within the scope of the present invention as defined by the appended claims, unless they depart therefrom.

We claim:

1. A fuel supply control system for an internal combustion engine which comprises:

a suction air detecting means for detecting information associated with the quantity of air sucked into the engine;

a fuel supply means for supplying into the engine a quantity of fuel determined in dependence on the quantity of air detected by the suction air detecting means so that the air-fuel ratio of combustion gases to be supplied into the engine will be one of at least two different values;

an acceleration detecting means for detecting acceleration of the engine;

a fuel increasing means for increasing in a predetermined amount the quantity of fuel to be supplied from the fuel supply means into the engine when the acceleration is detected;

means for detecting information associated with the air-fuel ratio of a combustible mixture to be supplied; and a rate-of-increase determining means responsive to respective signals from said acceleration detecting means and said means for detecting information associated with the air-fuel ratio for determining the value of increase of the fuel when the degree of acceleration exceeds a predetermined value, said rate of increase determining means including first determining means for determining a value of increase of the fuel in dependence on the acceleration then occuring, and second determining means for determining a value of increase of the fuel in dependence on the air-fuel ratio prevailing shortly before the acceleration and regardless of the air-fuel ratio assumed during the acceleration.

2. The system as claimed in claim 1, wherein said fuel supply means includes a fuel injection device for injecting the fuel at predetermined cycles.

3. The system as claimed in claim 2, wherein said increasing means increases the fuel injected by the fuel injecting device.

4. The system as claimed in claim 2, wherein said fuel supply means includes an asynchronous injecting means for injecting the fuel for a predetermined time independently of the fuel injection at the predetermined cycles when the acceleration is detected, said increasing means increasing the fuel to be supplied by means of said asynchronous injecting means.

5. The system as claimed in claim 1, wherein the detecting means for detecting an operating condition of the engine includes an air-fuel ratio sensor for detecting the air-fuel ratio.

6. The system as claimed in claim 3, wherein said fuel supply means includes an asynchronous injecting means for injecting the fuel for a predetermined time independently of the fuel injection at the predetermined cycles when the acceleration is detected, said increasing means increasing the fuel to be supplied by means of said asynchronous injecting means.

7. The system as claimed in claim 6, wherein the detecting means for detecting an operating condition of the engine includes an air-fuel sensor for detecting the air-fuel ratio.

8. The system as claimed in claim 4, wherein the detecting means for detecting an operation condition of the engine includes an air-fuel ratio sensor for detecting the air-fuel ratio.

9. The system as claimed in claim 5, wherein said fuel supply means includes a fuel injecting device for injecting the fuel at predetermined cycles and said increasing means increases the fuel injected by said fuel injecting device.

* * * * *